US006185743B1

(12) United States Patent
Mick

(10) Patent No.: US 6,185,743 B1
(45) Date of Patent: Feb. 13, 2001

(54) BEACH TOGA WITH PARTIAL BELT

(76) Inventor: John D. Mick, 6741 Silbaugh Dr., Pine River, MN (US) 56474

( * ) Notice: Under 35 U.S.C. 154(b), the term of this patent shall be extended for 0 days.

(21) Appl. No.: 09/329,545

(22) Filed: Jun. 10, 1999

(51) Int. Cl.[7] ..... A41D 3/08
(52) U.S. Cl. ..... 2/84; 2/69; 2/88
(58) Field of Search ..... 2/69, 69.5, 85, 2/88, 93, 114, 83, 51, 48, 46, 67, 89, 338

(56) References Cited

U.S. PATENT DOCUMENTS

| | | | | |
|---|---|---|---|---|
| 1,204,719 | * | 11/1916 | Van Heusen | 2/83 |
| 1,497,685 | * | 6/1924 | Hoyme | 2/114 |
| 2,535,936 | * | 12/1950 | Langley | 2/69.5 |
| 2,706,817 | | 4/1955 | Schneider . | |
| 2,897,508 | * | 8/1959 | Bashore et al. | 2/93 |
| 3,042,931 | | 7/1962 | Sawyer . | |
| 3,079,611 | | 3/1963 | Boryszewski . | |
| 3,176,315 | * | 4/1965 | Freund | 2/69 |
| 3,288,157 | * | 11/1966 | Szkolny | 2/69 |
| 3,837,006 | * | 9/1974 | Laseman | 2/69.5 |
| 4,067,066 | * | 1/1978 | Bruno | 2/69.5 |
| 4,180,867 | | 1/1980 | Ridgeway, Jr. . | |
| 4,484,362 | * | 11/1984 | Asher | 2/69 |
| 4,606,078 | | 8/1986 | Tkacsik . | |
| 4,656,670 | * | 4/1987 | Schluter | 2/69 |
| 4,703,521 | | 11/1987 | Asher et al. . | |
| 4,845,779 | | 7/1989 | Wheeler et al. . | |
| 5,367,709 | * | 11/1994 | Teasley | 2/69 |
| 5,611,083 | | 3/1997 | Arnold . | |
| 5,697,102 | * | 12/1997 | Benjamin | 2/69 |
| 6,018,830 | * | 2/2000 | Howe | 2/69.5 |

* cited by examiner

*Primary Examiner*—Amy B. Vanatta
(74) *Attorney, Agent, or Firm*—Albert W. Watkins

(57) ABSTRACT

A changing robe provides ample room for a person to change attire in public places without loss of modesty. The robe is provided with a draw string that encompasses the back, sides and only a fraction of the front of the robe, that may be drawn tight to convert the robe from a tent-like garment into a fashionable beach toga that may be worn by either sex. When the draw string is pulled tight, gathers form on the sides and back of the robe, while in contrast the front of the robe is smoothed and pulled closer to the person. The robe is short enough not to become entangled about ones legs during activities such as walking and running, but is provided with an extension along the back side, so that when a person bends down, the person remains covered.

9 Claims, 4 Drawing Sheets

BEACH TOGA WITH PARTIAL BELT

BACKGROUND OF THE INVENTION

1. Field of the Invention

This invention pertains generally to apparel. More specifically, the apparel is convertible from loose fitting clothing within which a person may undress and dress, while still maintaining modesty in a public place, into fashionable attire which is well fitted for general activities. Most preferably, the apparel also provides the additional functions of a bathing robe.

2. Description of the Related Art

Beaches and lake shores provide nearly ideal recreation for mankind. Diverse activities are available for a wide variety of people. Many will participate in water sports such as swimming, water skiing, and scuba diving. Others will use the shoreline as an access to the waters for fishing and boating. With the many different activities available, beaches, lake shores, river fronts and other large bodies of water are frequented by millions of people around the world each day. Often, multiple activities will be planned, so an individual will spend time upon the water, in the water, and along the shoreline, and may alternate between each more than once throughout the course of a day.

Unfortunately, the different activities generally require different clothing, and few of these locations have adequate facilities for persons wishing to change their attire. Frequently, a person may find themselves changing in an automobile, an outhouse, or even the woods. Such situations are frustrating at best, and may result in a person unintentionally or accidentally exposing themselves to others. Worse, irritating plants such as poison ivy that are kept out of public areas may thrive adjacent thereto, and a person attempting to change clothes may stumble right into a patch.

Where public facilities are provided, they are often, out of necessity, formed from concrete floors and walls. Concrete withstands heavy daily traffic of water, sand and other compounds for many years, and it is also quite easy to clean and maintain. Nevertheless, between cleaning the concrete provides a harbor for many germs and dirt, and can be quite unpleasant, particularly in congested areas. As a result, many people will forego changing in these public shelters and instead dress in other areas.

To provide a better alternative, Boryszewski in U.S. Pat. No. 3,079,611 illustrates a simple beach toga formed from two terry cloth towels, the teachings incorporated herein by reference. The towels are adapted to be suspended from a person's shoulders, and allow enough space for the person to change clothing. Furthermore, the terry cloth material is quite absorbent, and provides the dual function of drying. In spite of the improvements to the art made by Boryszewski, there still remain several drawbacks. For example, where a person would only pack a single towel, the Boryszewski beach toga requires two. Furthermore, the towels have to be fitted with fasteners, which tend to decrease the desirability of the resulting towel for it's primary applications of comfortably drying and also comfortably supporting a person upon sand or grass waterfronts.

More recently, Arnold, in U.S. Pat. No. 5,611,083 also incorporated herein by reference, discloses a changing robe designed for use at public beaches, for changing into and out of swimming gear. Like the Boryszewski toga, the Arnold robe is preferably made from terry cloth for absorbency and comfort, and serves the additional functions of drying and shielding a person from wind. Also like Boryszewski, the Arnold robe is quite large, to best address the changing function. Unfortunately, the Arnold robe is not well suited for activities other than the changing and shelter aforementioned, due to the robe interfering with the activity. For example, the robe will hang out enough to accidentally drop into or against a plate or food placed upon a table, making the robe undesirable during meal times, and an obstacle during clean-up thereafter. If the person participates in fishing, the robe hangs loosely enough to easily become snagged in fishing hooks and will tend to brush up against wet objects and fish. Therefore, during a single outing at the beach, a person might be required to put on and remove the Arnold robe many times if the person participates in more than swimming. Furthermore, the robe offers no form or fit, and so is aesthetically unpleasant and would not be desired to be worn except during changing of clothes.

SUMMARY OF THE INVENTION

In a first manifestation, the invention is a beach toga fabricated from a comfortable and absorbent fabric. The toga is draped over a person to allow the person to modestly and discretely perform certain activities such as changing attire within public places, and further converts to fashionable dress attire suitable for use during various social activities. A front and back form the primary covering. A drawstring only partially encircles the toga, and may be fully extended, or, alternatively, tensioned. In the fully extended position, both the back and front are fully extended, ensuring a large enclosed space visually isolated from exterior view. Within the large enclosure, a person can move around and change attire. In the tensioned position, the back gathers together in a vicinity of the drawstring to form a fashionable garment with gathers in the sides and back. The front is drawn to the person's waist without gathers, and the drawstring start and end are pulled around to the sides of the person. As a result of the newly formed gathers, a person could no longer move around within the enclosed space and change attire, and the garment will be held closely to the person.

In a second manifestation, the invention is a method for converting a beach changing robe into a fashionable garment. The steps include: anchoring a cincture horizontally offset from the center of the front, but still on the front; engaging the cincture with the garment back to maintain cincture and back adjacent; passing the cincture through the opposite side of the front; pulling the cincture taut and thereby gathering the back together, while consequently drawing the front closer to the back and further consequently tensioning the front against gathering; whereby the cincture is pulled from passing through the front in a front facing orientation on a person to opposite side facing orientations, and whereby the side edges are drawn behind the person.

OBJECTS OF THE INVENTION

A first object of the invention is to provide a garment that will allow a person to change clothing therein, without exposure or loss of modesty. A second object of the invention is to enable a person to convert the garment from a changing robe into fashionable clothing attire for continued application and use beyond dressing, which will not interfere with normal activities. A further object of the invention is to provide a single, consistent shape that may be worn by both sexes. Another object of the invention is to keep the robe short enough to be worn during activities at the beach without the robe becoming tangled up or tripping the wearer, while simultaneously having enough fabric to adequately cover the same person when the person bends over during changes of attire or other activity. These and other objects are accomplished in the preferred embodiment, which will be better understood when considered in conjunction with the appended drawing figures.

DESCRIPTION OF THE PREFERRED EMBODIMENT

Figure 1:
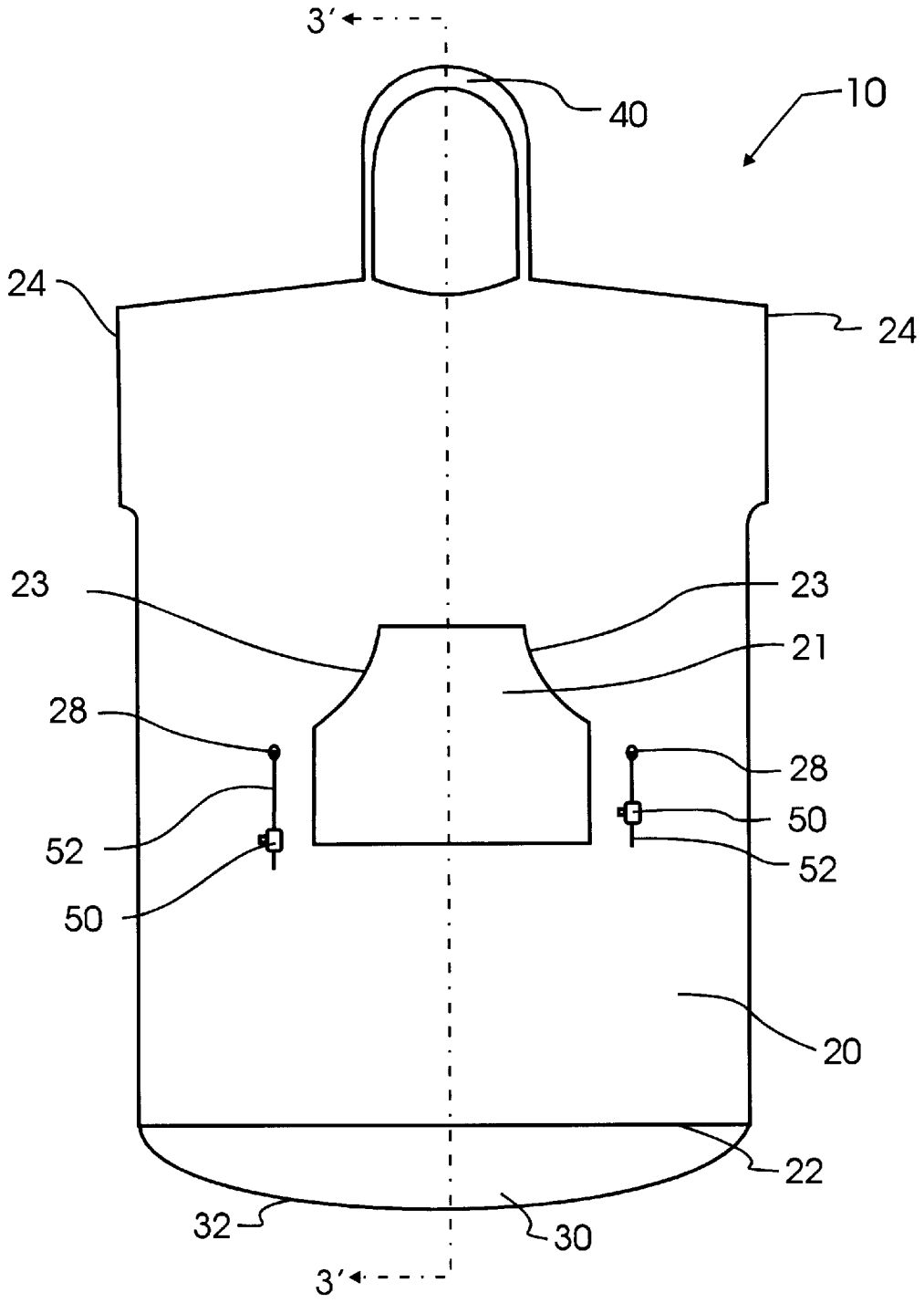
FIG. 1 illustrates a preferred embodiment of the invention from a front view with the robe laid flat on a surface.

Beach toga 10, visible in each of the figures, is preferably fabricated from two relatively soft and absorbent generally square or rectangular fabric pieces that form front panel 20 and back panel 30. Most preferably, toga 10 is made from terry cloth, though other fabrics are known that will have particular advantage for a given application. Toga 10 will most preferably extend to knee length in front, since it is most desirable for the present invention not to interfere with walking, running and other activities. Unfortunately, this length may not adequately cover all persons when they bend forward or reach down to the ground. Therefore, back 30 will most preferably also have a slightly curved bottom seam 32 which extends farther than bottom seam 22 of front 20. The exact geometry of the extended bottom seam 32 is not critical to the invention, though the gentle curve is most preferred for aesthetic reasons. In the preferred embodiment for an average adult, the shoulder to bottom length is approximately 40 inches in front and 44 inches in back, and the front and back are each approximately 36 inches wide. Obviously, the exact dimensions will vary depending upon the dress size of the person, such that smaller children will have substantially smaller dimensions, though the proportions may remain fairly constant.

On the exterior surface of front 20 is a pocket 21 which is an additional fabric panel that is anchored or stitched to front 20 along all edges, except for arcuate openings 23, to allow a person to slip their hands between front panel 20 and pocket 21. Sleeves 24 are most preferably open sufficiently to allow a person to readily pull their arms inside of toga 10, without any difficult or complicated gyrations. Otherwise, sleeves 24 are simple openings where front 20 is not stitched to back 30. Sleeves 24 in the preferred embodiment are kept simple in design, to not require special finishing beyond that normally required for edges, such as hemming or taping. Nevertheless, it may be desirable in some instances to provide partial sleeves or other forms of sleeves known in the more general field of apparel which might, for example, extend sufficiently to further conceal a person changing within toga 10.

Hood 40, which is not essential but preferable, may be a simple hood, as illustrated, or may conceivably include various drawstrings or attachments that could make hood 40 removable, if desired. Hood 40 is particularly useful and beneficial in cooler weather, on windier days, or otherwise when additional shelter is most preferable, such as from the sun. As is visible in FIG. 3, a pocket 26 may also be provided on the inside surface of front 20. Pocket 26 may hold articles such as hairbrushes, clothing, swimsuits, undergarments, and other various items, and the size of pocket 26 is not critical to the performance of the present invention.

Figure 2:
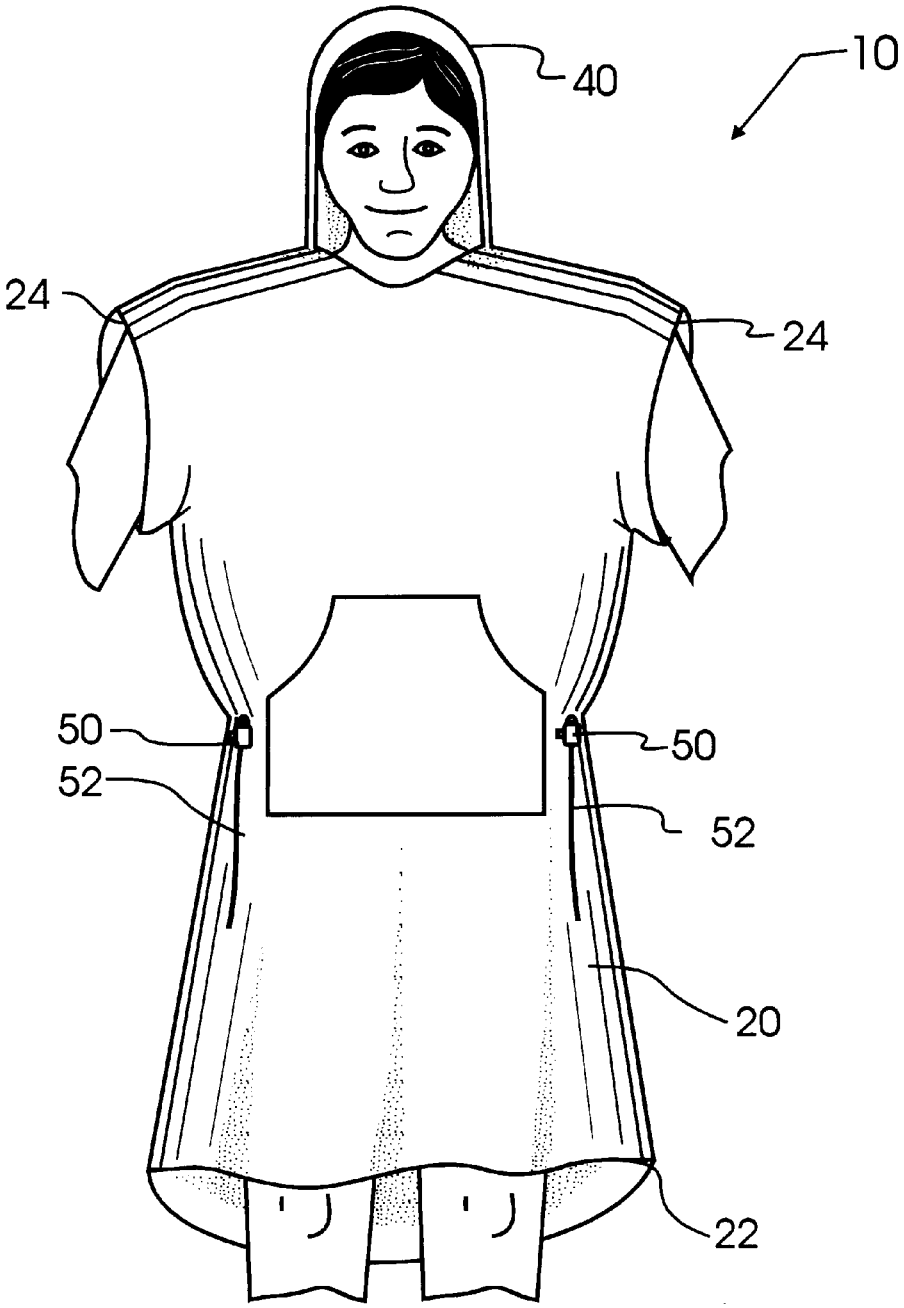
FIG. 2 illustrates the preferred embodiment robe drawn taut about a person from a front view.
Figure 3:
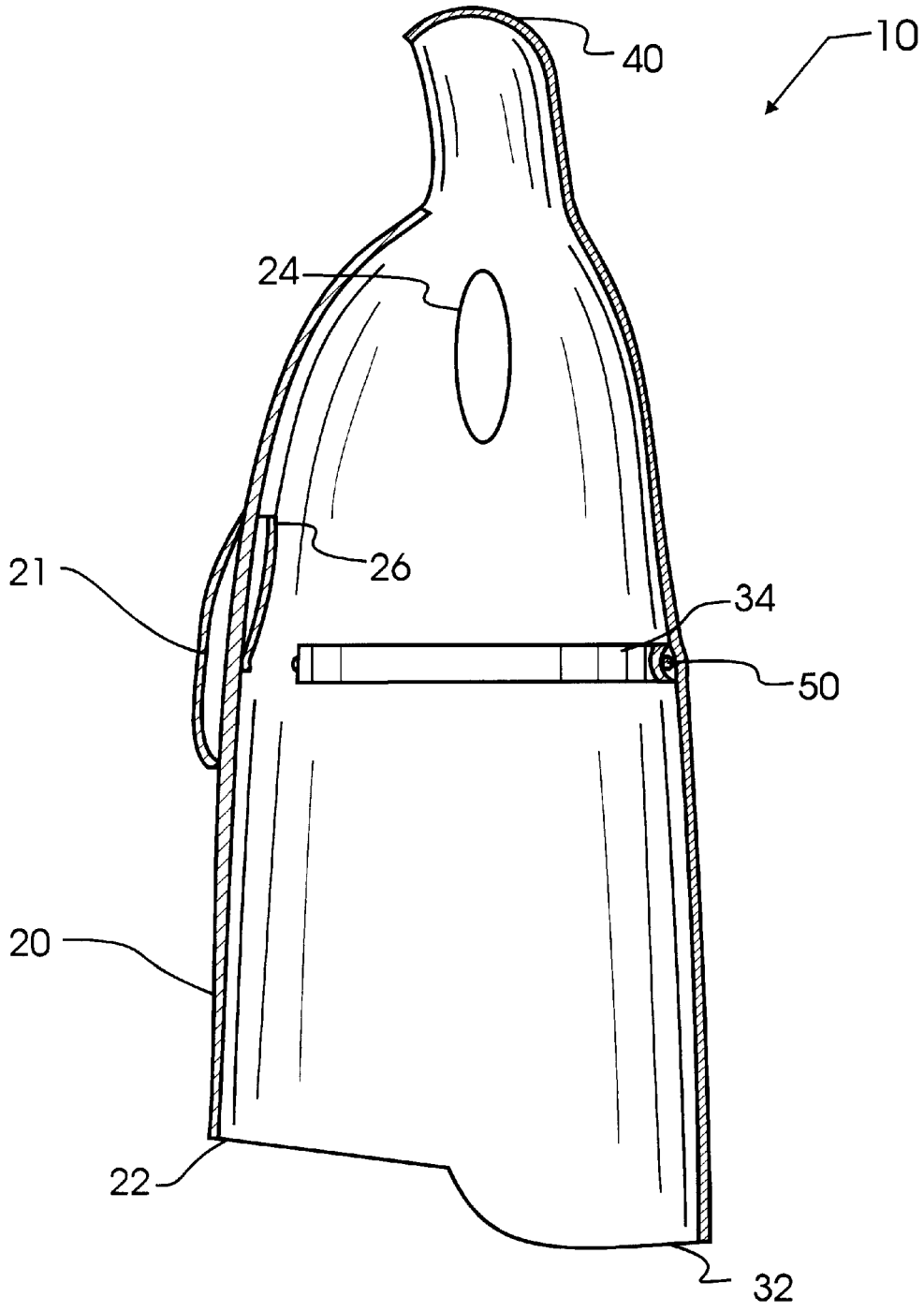
FIG. 3 illustrates the preferred embodiment robe from a side cut-away view illustrating the space available for a person to change attire within, taken along line 3' of FIG. 1.
Figure 4:
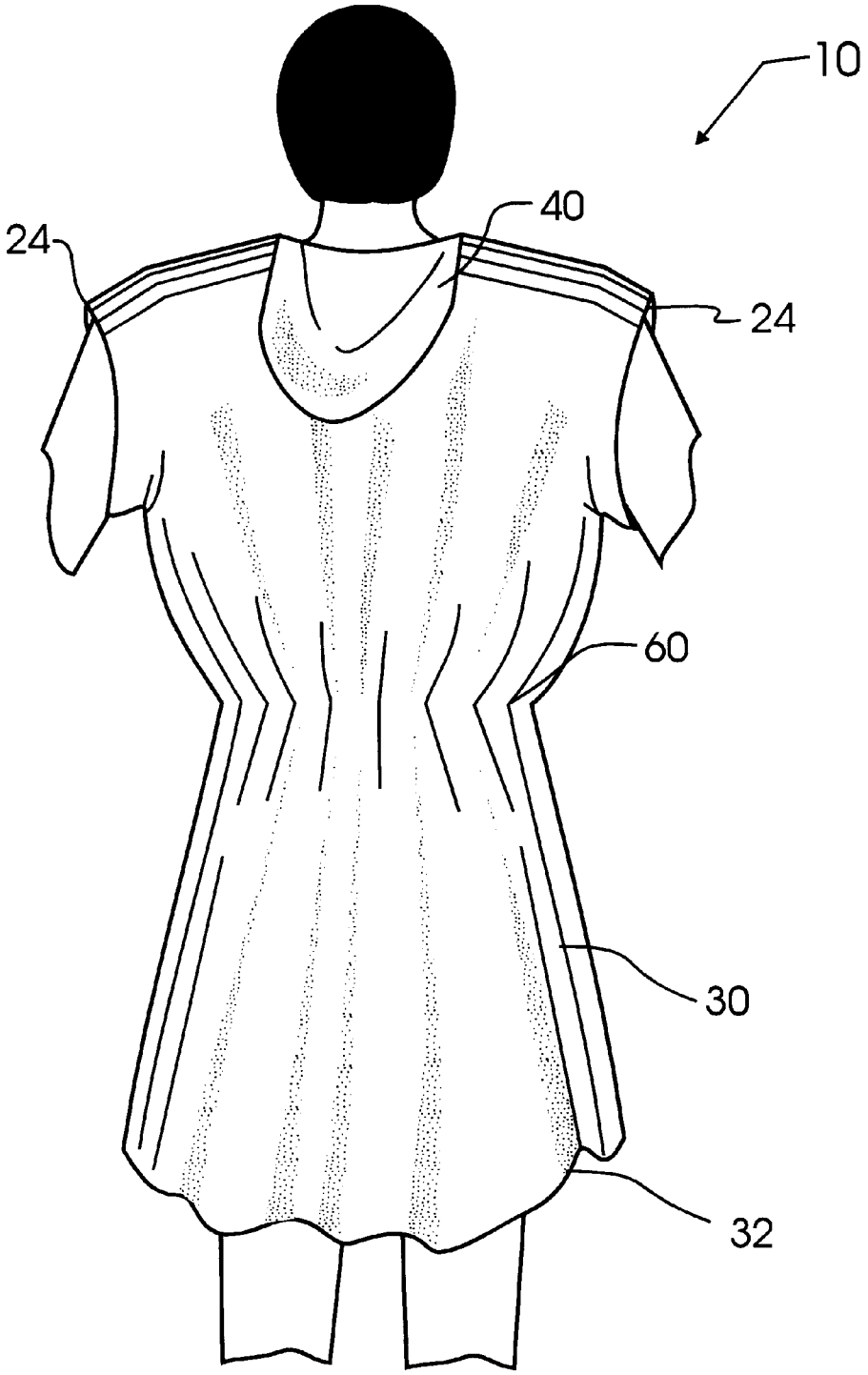
FIG. 4 illustrates the preferred embodiment robe of FIG. 3 from a back view, converted to fashionable attire in accord with the teachings of the invention, showing the gathering of the fabric and coverage.

Extending through the outer perimeter of front 20, in an area that would be adjacent a person's sides, are two openings or eyelets 28. Eyelets 20 provide an opening through which drawstring 50 will pass. Within robe 10 at approximately waist height, a small fold, tube, or guide 34 is provided through which drawstring 50 passes. Guide 34 must only serve to retain drawstring 50 to the front 20 and back 30 of robe 10, so either internal loops, a separate tube, or other 10 functionally comparable structure will suffice. In the preferred embodiment, an elongated panel of fabric will form guide 34, the panel sewn along the long edges to the front panel 20 and back panel 30, and drawstring 50 inserted between. At the exposed ends of drawstring 50, as shown in FIG. 2, spring fasteners 52 are provided. Fasteners 52 are known in the art of drawstrings to grab drawstring 50 in a tight and non-slip manner, unless and until a person grasps fasteners 52 appropriately and squeezes to release spring tension otherwise applied to drawstring 50. When fasteners 52 are grasped to release spring tension, fasteners 52 may then be slid upon drawstring 50 to adjust or tension drawstring 50. The combination of guide 34, drawstring 50 and fasteners 52 provides the mechanism to convert beach toga 10 from a changing robe, as shown in FIGS. 1 and 3 with excess space between front 20 and back 30, into a fashionable robe with gathers 60 in back 30, as shown in FIGS. 2 and 4. Excess material is drawn around to the back of the robe, which is critical to the functionality, appearance and desirability of the robe. As a changing robe with excess fabric to interfere with activities, there is little consumer interest in the apparel, as evidenced by the many years of availability of the prior art noted hereinabove, beginning with the Boryszewski toga application filed almost a half century ago. Expanding the capabilities of the apparel, by the provision of the partial belt, enables toga 10 to be worn by persons of both sexes without toga 10 appearing to be a dress intended only for females. Further toga 10 has a quite fashionable appearance well suited for the diverse activities that are commonly encountered in association with water related recreation, and the critical front surface is unhampered by gathers which might otherwise interfere with certain activities. Furthermore, front pockets 21 and 26 remain unblocked by gathers, which, with a full belt would inhibit access. The further provision of a back extension towards the ground along seam 32 even further enhances the suitability of toga 10.

Beyond water related activities, it will be apparent that the toga 10 of the present invention may be used for many diverse activities and by many different people. For example, toga 10 will serve as very comfortable casual attire around the house, which may be first donned after bathing or showering. Toga 10 further accommodates persons of limited abilities or range of motion, since toga 10 is so readily slipped into and removed. With the additional width of toga 10, a person will not have to raise their arms over their head when donning, and yet the drawstring 50 allows toga 10 to be pulled into a much more fashionable garment. Other applications for the present invention include gyms, salons and spas, physical therapy, nursing, and any other activities requiring either ease of access or extra space, combined with a garment that may be converted into fashionable attire.

While the foregoing details what is felt to be the preferred embodiment of the invention, no material limitations to the scope of the claimed invention is intended. Further, features and design alternatives that would be obvious to one of ordinary skill in the art are considered to be incorporated herein. The scope of the invention is set forth and particularly described in the claims hereinbelow.

I claim:

1. A method for converting a beach changing robe having a front, a back and a normally vertical orientation when worn upon a standing person into a fashionable garment, said front having first and second side edges and a top and bottom, comprising the steps of:

anchoring a cincture at a first point horizontally offset in a first direction from a center of said front and still on said front;

engaging said cincture with said back at a second point horizontally offset from said first point to maintain said cincture adjacent said back at said second point;

slidably passing said cincture through a third point on said front horizontally offset in a second direction opposite said first direction from said center; and pulling said cincture taut between said first and third points and thereby gathering said back together, while consequently drawing said front closer to said back and further consequently tensioning said front against gathering.

2. The method for converting a beach changing robe into a fashionable garment of claim 1, wherein said first and third points are pulled from a front facing orientation on said person to opposite side facing orientations and said side edges are drawn behind said person.

3. The method for converting a beach changing robe into a fashionable garment of claim 1, wherein said step of engaging further comprises the additional step of forming a casing with said back through which said cincture may pass.

4. The method for converting a beach changing robe into a fashionable garment of claim 3, wherein said step of engaging further comprises the additional step of inserting said cincture through said casing.

5. The method for converting a beach changing robe into a fashionable garment of claim 1, comprising the step of providing an extension to said back to further extend said back towards said ground beyond said front.

6. The method for converting a beach changing robe into a fashionable garment of claim 1, further comprising the step of providing a hood.

7. The method for converting a beach changing robe into a fashionable garment of claim 1, further comprising the step of providing a front pocket opposite said front from said back.

8. The method for converting a beach changing robe into a fashionable garment of claim 1, further comprising the step of providing a front pocket on said front, on a front side most adjacent said back.

9. The method for converting a beach changing robe into a fashionable garment of claim 1, further comprising the step of changing attire within said beach changing robe prior to said pulling step.

* * * * *